US012336608B1

(12) United States Patent
Lin

(10) Patent No.: US 12,336,608 B1
(45) Date of Patent: Jun. 24, 2025

(54) CARD HOLDER WALLET

(71) Applicant: Zhongwei Lin, Luoding (CN)

(72) Inventor: Zhongwei Lin, Luoding (CN)

( * ) Notice: Subject to any disclaimer, the term of this patent is extended or adjusted under 35 U.S.C. 154(b) by 0 days.

(21) Appl. No.: 19/016,114

(22) Filed: Jan. 10, 2025

Related U.S. Application Data

(63) Continuation-in-part of application No. 18/617,667, filed on Mar. 27, 2024, now abandoned.

(51) Int. Cl.
*A45C 11/18* (2006.01)

(52) U.S. Cl.
CPC ..... *A45C 11/182* (2013.01)

(58) Field of Classification Search
CPC ..... A45C 11/182; A45C 13/30; A45C 1/06; A45C 1/00; A45C 11/18
USPC ..... 150/147
See application file for complete search history.

(56) References Cited

U.S. PATENT DOCUMENTS

2013/0276943 A1* 10/2013 Minn ..... A45C 1/06 150/137

* cited by examiner

*Primary Examiner* — Nathan J Jenness
*Assistant Examiner* — Jessica Kavini Tamil

(57) ABSTRACT

A card holder wallet includes a first clamping plate, a second clamping plate and an elastic band. Two pillars are arranged at intervals on an outer side of the first clamping plate, a sleeving through hole is formed at each of two ends of the elastic band, and the sleeving through hole extends along a width direction of the elastic band. Both ends of the elastic band are sleeved on the two pillars respectively, and the two pillars are respectively positioned in the sleeving through holes at the two ends of the elastic band; the elastic band is looped around the second clamping plate away from an outer surface of the first clamping plate, the first clamping plate is located away from an outer surface of the second clamping plate, and there is no elastic band wound between the two pillars.

20 Claims, 17 Drawing Sheets

CARD HOLDER WALLET

CROSS-REFERENCE TO RELATED APPLICATIONS

This application is a Continuation-in-Part of the U.S. application Ser. No. 18/617,667 filed on Mar. 27, 2024, and entitled "MULTIFUNCTIONAL CARD CLIP" now pending, the entire disclosures of which are incorporated herein by reference.

TECHNICAL FIELD

The present disclosure relates to the technical field of card holders, in particular to a card holder wallet.

BACKGROUND

Currently, each existing card holder is equipped with an annular elastic band tied to the outside of its two rigid clamping plates. However, as both sides of the existing card holder are covered by the elastic band, the integrity of its overall appearance is undermined. Moreover, the elastic band is liable to slip off the clamping plates, which makes the card holder inconvenient to open and use. Besides, it fails to fully showcase the appearance of the card holder and thus affects users' usage experience.

SUMMARY

The main purpose of the present disclosure is to provide a card holder wallet to solve the problem that the annular elastic band on the existing card holders is prone to slipping off the two clamping plates and affecting the user experience.

In order to solve the technical problem, the technical scheme provided by the present invention is as follows.

A card holder wallet includes a first clamping plate, a second clamping plate and an elastic band. Two pillars are arranged at intervals on an outer side of the first clamping plate, a sleeving through hole is formed at each of two ends of the elastic band, and the sleeving through hole extends along a width direction of the elastic band.

Both ends of the elastic band are sleeved on the two pillars respectively, and the two pillars are respectively positioned in the sleeving through holes at the two ends of the elastic band; the elastic band is looped around the second clamping plate away from an outer surface of the first clamping plate, the first clamping plate is located away from an outer surface of the second clamping plate, and there is no elastic band wound between the two pillars.

Furthermore, the first clamping plate is provided with an avoidance hole adjacent to each of two sides of the first clamping plate, the pillar is formed by a side wall of the first clamping plate and an inner side wall of the avoidance hole being spaced apart, and the pillar is provided with a notch for sleeving the elastic band onto the pillar.

Furthermore, the notch is not located at an end position of the pillar.

Furthermore, the notch is located at a middle of the pillar or adjacent to the middle of the pillar.

Furthermore, the elastic band is provided with an anti-damaging layer for increasing strength on an inner side wall corresponding to the sleeving through hole, a material of the anti-damaging layer is a glue or a resin layer, and the anti-damaging layer is located at the notch.

Furthermore, the card holder wallet further includes a spacer configured to prevent the elastic band from being squeezed with the pillar at the notch when being stretched, the spacer covers the notch, and the spacer is located between the elastic band and the pillar.

Furthermore, the spacer includes a first baffle plate and second baffle plates extending from both ends of the first baffle plate, an embedding groove surrounded by the first baffle plate and the two second baffle plates is formed, and the notch and at least part of the pillar are placed within the embedding groove.

Furthermore, the spacer is formed by bending a piece of metal sheet.

Furthermore, a width of the notch matches substantially a thickness of the elastic band.

Furthermore, the width of the notch is greater than the thickness of the elastic band by 0 mm to 5 mm.

Furthermore, the number of the elastic bands is one, and both ends of the elastic band are folded back and forth and then sewn to form the sleeving through holes.

Furthermore, the elastic band is in a ring shape, the sleeving through holes located at both ends of the elastic band are connected to each other, and the number of layers of the elastic band on the outer surface of the second clamping plate is two, arranged in an overlapping manner.

Furthermore, the number of the elastic bands is one, and two ends of the elastic band are connected to form a ring shape; a shielding member is arranged around a joint of the two ends of the elastic band, and the shielding member is provided with a logo.

Furthermore, an anti-slip rubber pad is arranged on one side of the elastic band adjacent to the outer surface of the second clamping plate for increasing a frictional force between the elastic band and the second clamping plate.

Furthermore, a decorative cover plate is arranged on the outer surface of the first clamping plate and/or the outer surface of the second clamping plate.

Furthermore, the decorative cover plate is formed by splicing at least two different materials.

Furthermore, the decorative cover plate is formed by injection molding after putting a hard plate into a mold and adding a molten material.

Furthermore, the hard plate is one or more of wood blocks, stones, metal blocks, carbon fiber blocks, plastics and resins, and the molten material is one or more of plastics, resins and metals.

Furthermore, the second clamping plate is a card box, the card box includes a shell, a card pushing member, a reset member and a driving member for users to operate, an accommodating groove with one side being an opening is arranged inside the shell, the accommodating groove is configured to store cards, the card pushing member and the reset member are placed inside the accommodating groove, the card pushing member is rotatably arranged inside the shell, one end of the reset member is fixed on the shell, the other end of the reset member is fixed on the card pushing member, and the driving member is movably arranged on the shell and is connected to the card pushing member. When the driving member is operated, the card pushing member rotates to push a card out of the accommodating groove, and after the card pushing member is rotated, the reset member generates a reset acting force to drive the card pushing member to return to its initial position. The shell includes a back surface and a front surface opposite to the back surface, the front surface is opposite to the first clamping plate, and the elastic band bypasses from the back surface.

Furthermore, the back surface is provided with a card sleeve, at least one of the card sleeves is provided with a card groove for inserting the card, and at least part of the opening of the card groove is located inside a periphery of the card sleeve.

Beneficial effects: Compared with the prior art, one end of the elastic band is sleeved onto the pillar of the first clamping plate. Then, the elastic band is looped around the outer surface of the second clamping plate. Finally, the other end of the elastic band is sleeved on the other pillar of the first clamping plate. In this way, under the action of the elastic band, the distance between the first clamping plate and the second clamping plate can be adjusted and they can move closer to each other. Based on this, when the user needs to store a card, the first and second clamping plates and can be separated, and the card is placed between them. Then, the force separating the first and second clamping plates and is released. That is, under the restoring force of the elastic band, the first clamping plate and the second clamping plate can clamp the card, thus playing the role of storing the card. When the user takes out the card, the first clamping plate can also be moved away from the second clamping plate to take out the card. Moreover, both ends of the elastic band are respectively sleeved on the two pillars of the first clamping plate, thereby limiting the elastic band. In this way, during the use process, the elastic band will not easily slip off the first clamping plate and the second clamping plate, making the connection between the first clamping plate and the second clamping plate more stable and improving the user experience.

BRIEF DESCRIPTION OF THE DRAWINGS

In order to explain the technical solutions of the embodiments of the present invention more clearly, the following will briefly introduce the accompanying drawings used in the embodiments. Apparently, the drawings in the following description are only some embodiments of the present invention. Those of ordinary skill in the art can obtain other drawings based on these drawings without creative work.

DETAILED DESCRIPTION OF THE EMBODIMENTS

Figure 1:
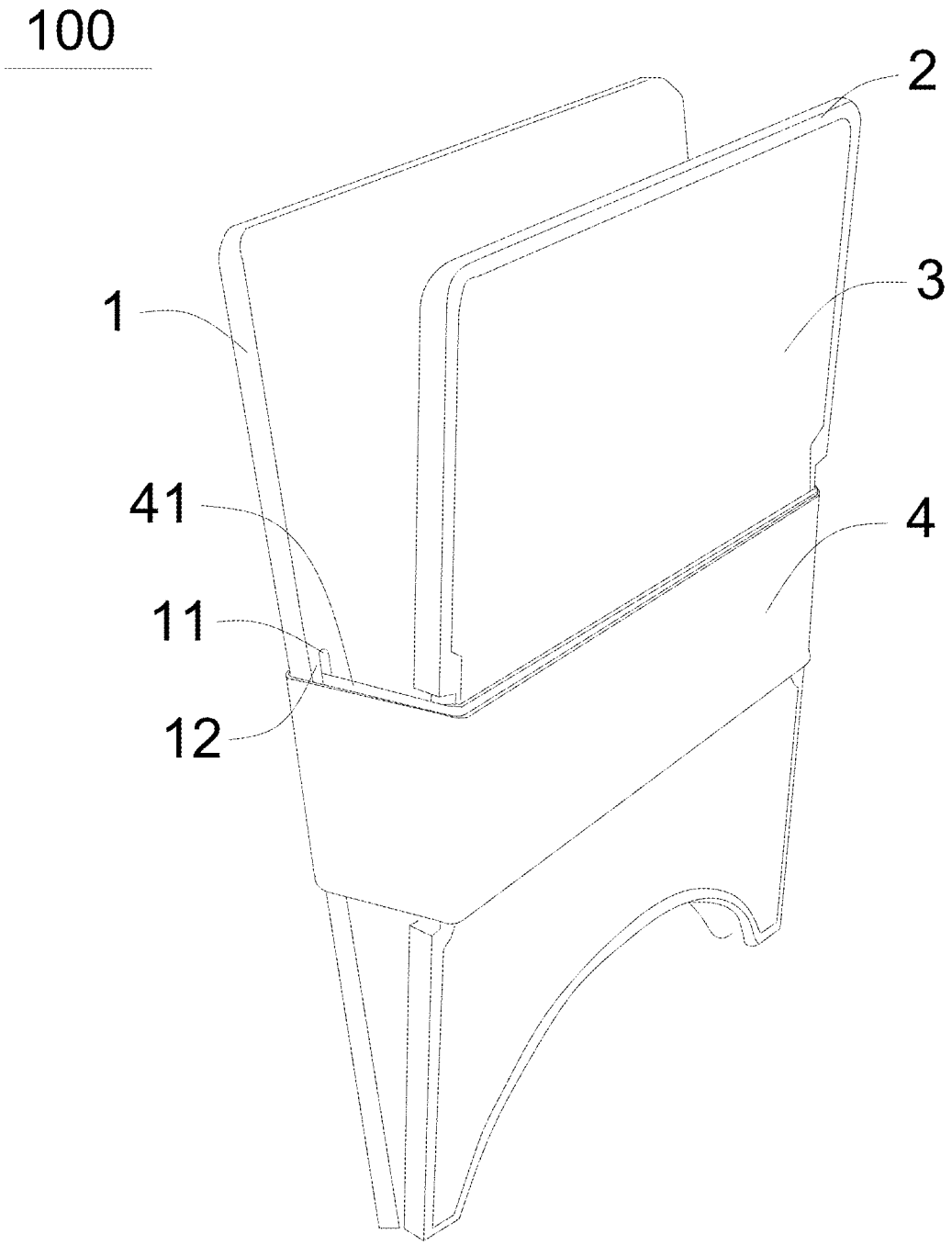
FIG. 1 is a three-dimensional schematic diagram of a vertical-style card holder wallet of the present disclosure.
Figure 2:
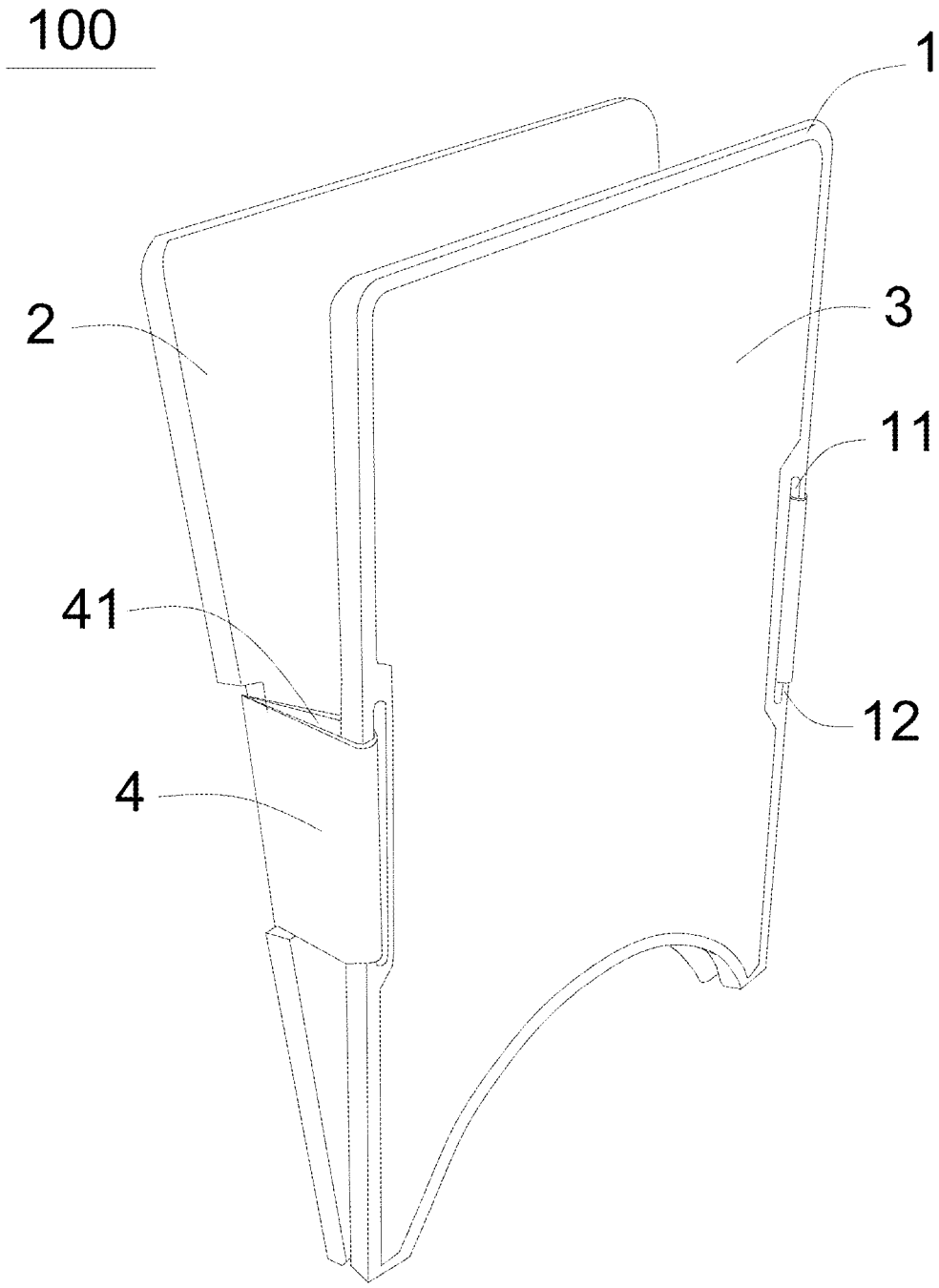
FIG. 2 is a three-dimensional schematic diagram of the vertical-style card holder wallet from another view of the present disclosure.
Figure 3:
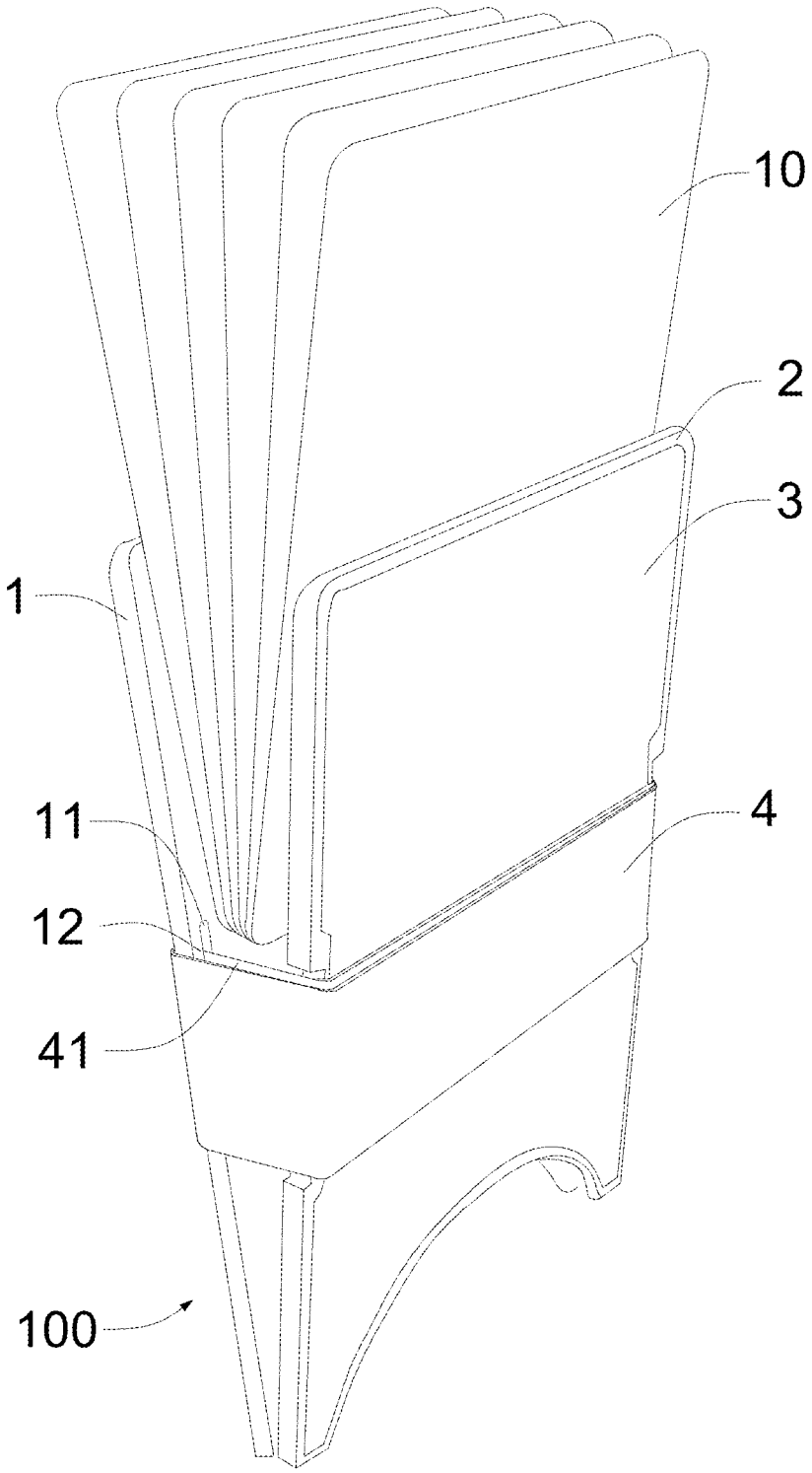
FIG. 3 is a schematic diagram in a state of cards stored between a first clamping plate and a second clamping plate of the vertical-style card holder wallet of the present disclosure.
Figure 4:
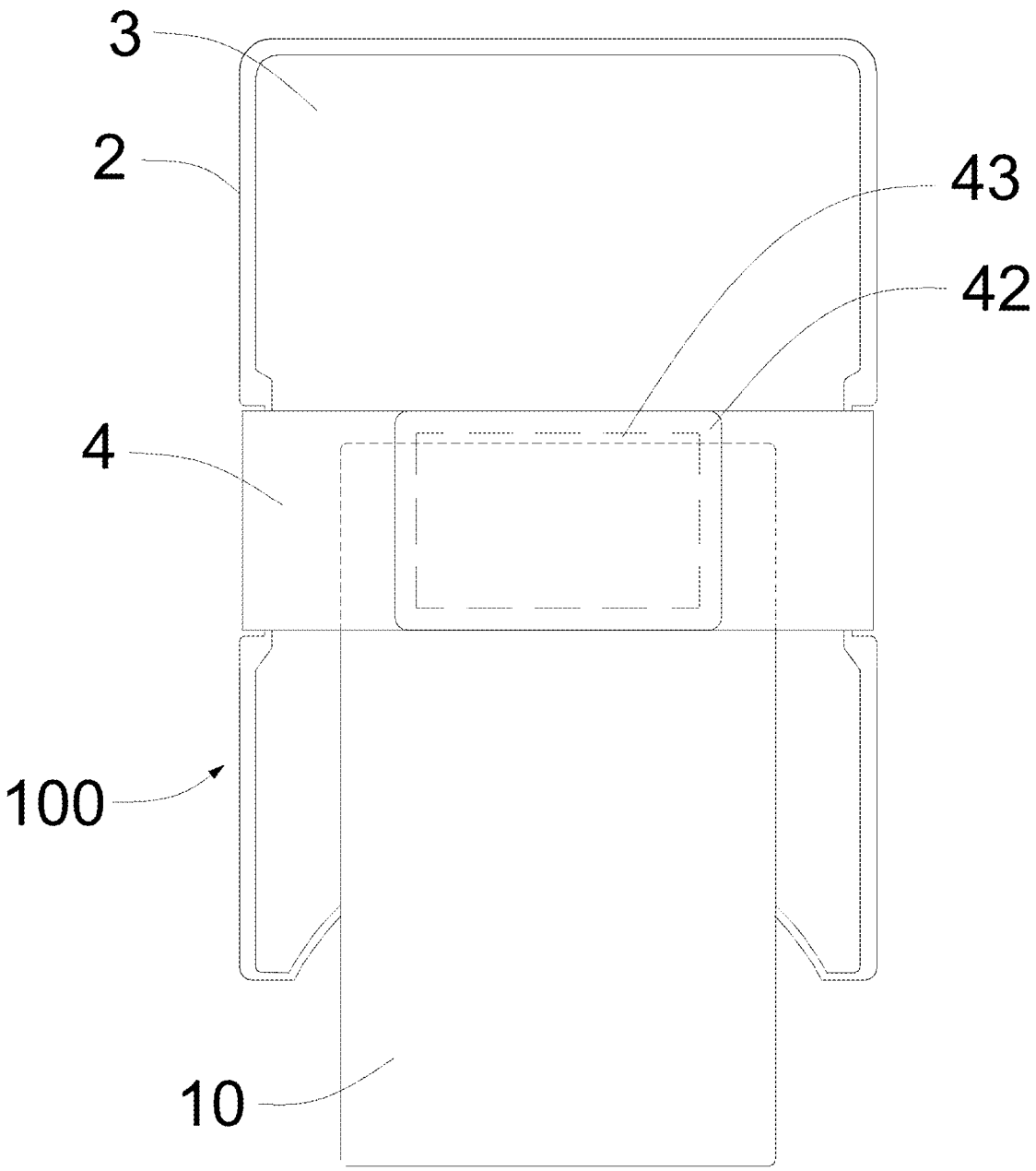
FIG. 4 is a schematic diagram in a state of banknotes stored between the second clamping plate and an elastic band of the vertical-style card holder wallet of the present disclosure.

The technical solutions in the embodiments of the present invention will be clearly and completely described below in conjunction with the accompanying drawings in the embodiments of the present invention. Apparently, the described embodiments are only a part of the embodiments of the present invention, rather than all the embodiments. Based on the embodiments in the present invention, all other embodiments obtained by those ordinarily skilled in the art without doing creative work shall fall within the protection scope of the present invention.

Referring to FIG. 1 to FIG. 18, an embodiment of the present disclosure provides a card holder wallet 100 and 100'.

The card holder wallet 100 and 100' includes a first clamping plate 1, a second clamping plate 2 and an elastic band 4. Two pillars 12 are arranged at intervals on an outer side of the first clamping plate 1. A sleeving through hole 41 is formed at each of two ends of the elastic band 4, and the sleeving through hole 41 extends along a width direction of the elastic band 4. Both ends of the elastic band 4 are sleeved on the two pillars 12 respectively, and the two pillars 12 are respectively positioned in the sleeving through holes 41 at the two ends of the elastic band 4. The elastic band 4 is looped around the second clamping plate 2 away from an outer surface of the first clamping plate 1, the first clamping plate 1 is located away from an outer surface of the second clamping plate 2, and there is no elastic band 4 wound between the two pillars 12.

In this embodiment, one end of the elastic band 4 is sleeved onto the pillar 12 of the first clamping plate 1. Then, the elastic band 4 is looped around the outer surface of the second clamping plate 2. Finally, the other end of the elastic band 4 is sleeved on the other pillar 12 of the first clamping plate 1. In this way, under the action of the elastic band 4, the distance between the first clamping plate 1 and the second clamping plate 2 can be adjusted and they can move closer to each other. Based on this, when the user needs to store a card 10, the first and second clamping plates 1 and 2 can be separated, and the card 10 is placed between them. Then, the force separating the first and second clamping plates 1 and 2 is released. That is, under the restoring force of the elastic band 4, the first clamping plate 1 and the second clamping plate 2 can clamp the card 10, thus playing the role of storing the card 10. When the user takes out the card 10, the first clamping plate 1 can also be moved away from the second clamping plate 2 to take out the card 10. Moreover, both ends of the elastic band 4 are respectively sleeved on the two pillars 12 of the first clamping plate 1, thereby limiting the elastic band 4. In this way, during the use process, the elastic band 4 will not easily slip off the first clamping plate 1 and the second clamping plate 2, making the connection between the first clamping plate 1 and the second clamping plate 2 more stable and improving the user experience.

Furthermore, by the elastic band 4 looping around the outer surface of the second clamping plate 2, it can be used to clamp banknotes between the elastic band 4 and the second clamping plate 2, thus enhancing the practicality of the card holder wallet 100 and 100' in this embodiment. Moreover, since the elastic band 4 does not warp around the area between the two pillars 12 and the outer surface of the first clamping plate 1, the distribution of the elastic band 4 can be reduced. When the two pillars 12 are located on both sides of the first clamping plate 1, the outer surface of the first clamping plate 1, which is away from the outer surface of the second clamping plate 2, has no elastic band 4 covering it. This makes the outer surface of the first clamping plate 1 near 100% bare, thereby improving the aesthetics of the card holder wallet 100 and 100'.

Figure 5:
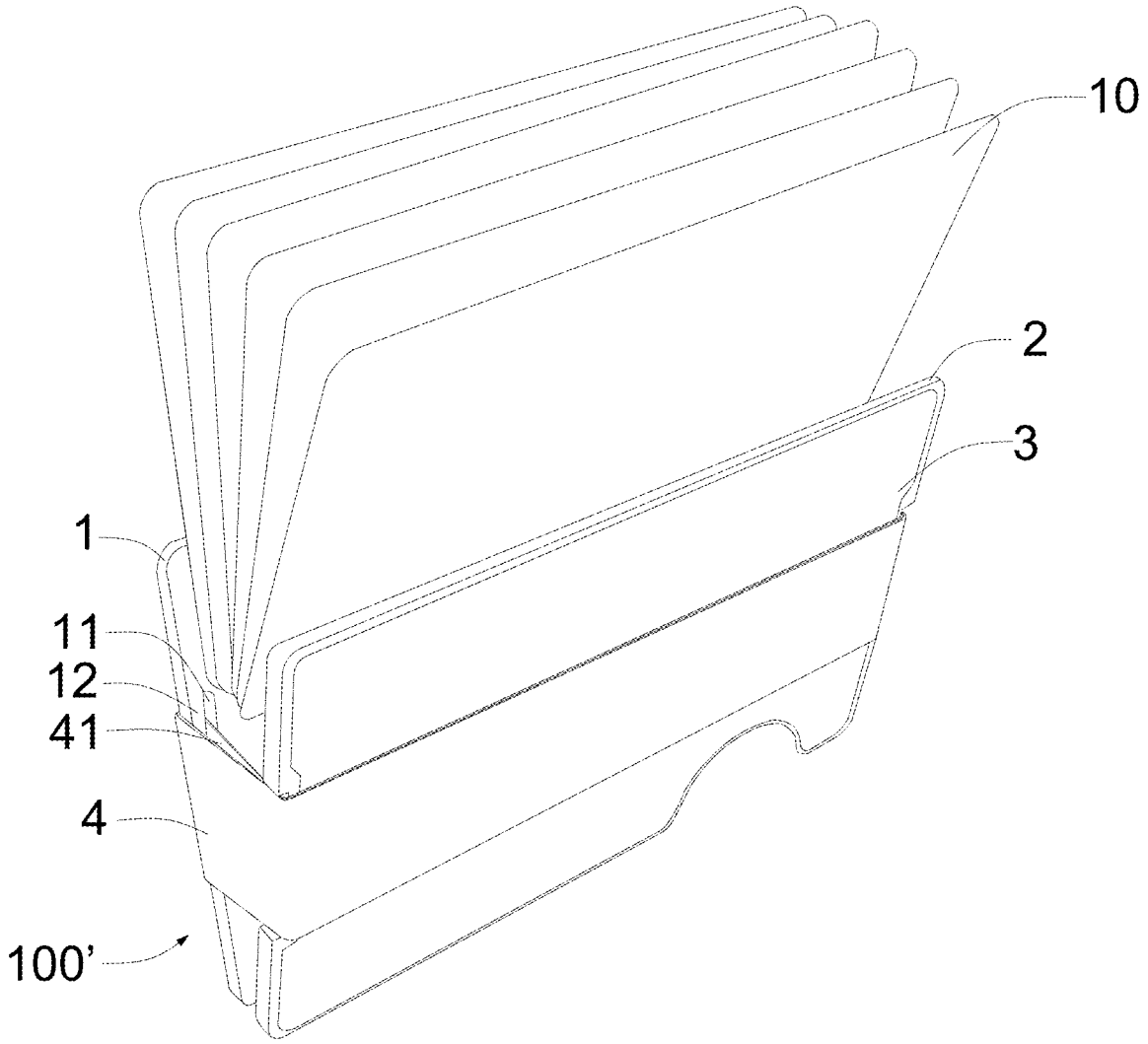
FIG. 5 is a schematic diagram in a state of cards stored between the first clamping plate and the second clamping plate of a horizontal-style card holder wallet of the present disclosure.
Figure 6:
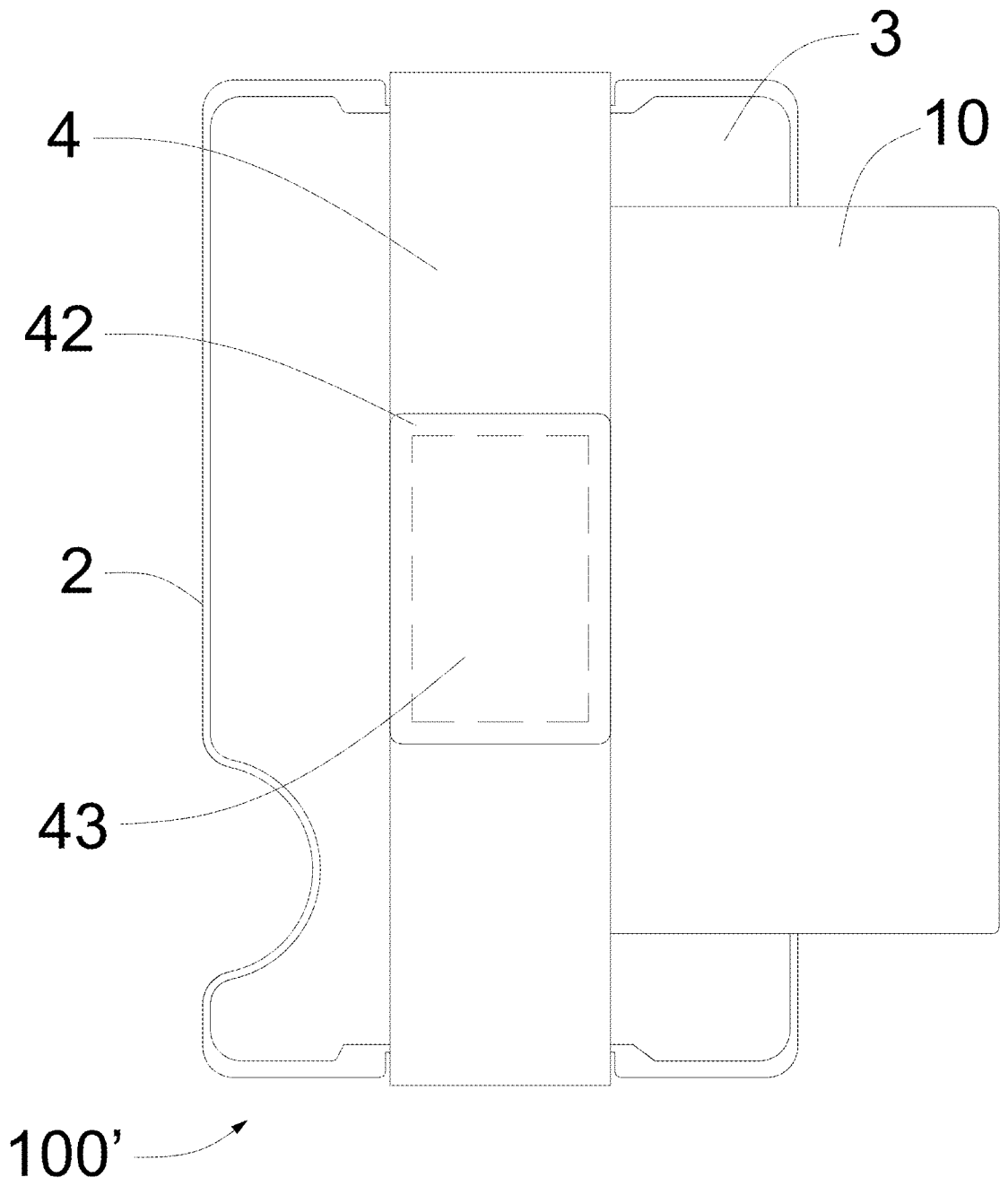
FIG. 6 is a schematic diagram in a state of banknotes stored between the second clamping plate and the elastic band of the horizontal-style card holder wallet of the present disclosure.

Furthermore, FIG. 1 to FIG. 4 are schematic diagrams of the vertical-style card holder wallet 100, that is, the card 10 is stored in the vertical direction of the card 10. FIG. 5 and FIG. 6 are schematic diagrams of the horizontal-style card holder wallet 100', in which the card 10 is stored horizontally.

In an embodiment, the first clamping plate 1 is provided with an avoidance hole 11 adjacent to each of two sides of the first clamping plate 1, the pillar 12 is formed by the side wall of the first clamping plate 1 and the inner side wall of the avoidance hole 11 being spaced apart, and the pillar 12 is provided with a notch 13 for sleeving the elastic band 4 onto the pillar 12. The pillar 12 is integrally formed with the first clamping plate 1 to facilitate the production and manufacturing of the card holder wallet 100 and 100' in this embodiment. Moreover, the two pillars 12 are located on both sides of the first clamping plate 1, which means that the elastic band 4 will not cover the outer surface of the first clamping plate 1 away from the second clamping plate 2. Additionally, using the notch 13 as an entrance makes it easier to sleeve both ends of the elastic band 4 onto the pillar 12.

In an embodiment, the width of the notch 13 matches substantially the thickness of the elastic band 4. It should be understood that the width of the notch 13 can be slightly wider than the thickness of the elastic band 4, or the width of the notch 13 can be slightly less than the thickness of the elastic band 4. Since the thickness of the elastic band 4 can become slightly thinner during the stretching process, that is, the width of the notch 13 can be slightly less than the thickness of the elastic band 4, and the two ends of the elastic band 4 can still be sleeved onto the pillar 12 via the notch 13. Moreover, in this structure, it is difficult for the two ends of the elastic band 4 to disengage from the pillar 12 via the notch 13. Certainly, in other relatively preferred embodiments, the width of the notch 13 can also be wider than the thickness of the elastic band 4 by 0 mm to 5 mm. Here, it should be noted that the width of the notch 13 is not limited here, that is, the width of the notch 13 can also be 6 mm, 8 mm and so on.

In an embodiment, the notch 13 is not located at the end position of the pillar 12. That is, when both ends of the elastic band 4 are sleeved onto the pillar 12 through the notch 13, the notch 13 is located within the sleeving through hole 41. In other words, under the cover of the two ends of the elastic band 4, it is difficult for the two ends of the elastic band 4 to detach from the pillar 12 through the notch 13. In the preferred embodiment, the notch 13 is located at the middle of the pillar or adjacent to the middle of the pillar. In a relatively preferred embodiment, the notch 13 is located at a position adjacent to the end of the pillar 12. Certainly, in other embodiments, the notch 13 can also be located at the end position and so on. Here, the position of the notch 13 on the pillar 12 is not limited.

Figure 11:
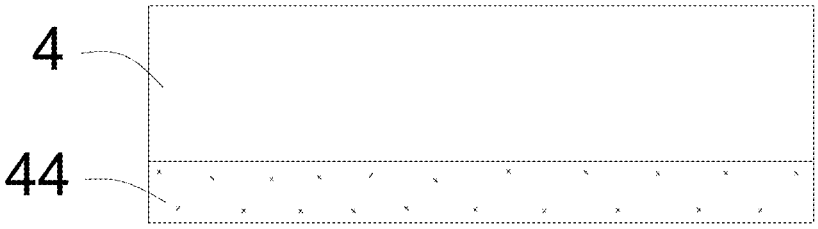
FIG. 11 is a partial schematic diagram of a joint between the elastic band and an anti-damaging layer of the present disclosure.

In an embodiment, the elastic band 4 is provided with an anti-damaging layer 44 for increasing strength on the inner side wall corresponding to the sleeving through hole 41. As shown in FIG. 11, the material of the anti-damaging layer 44 is a glue or a resin layer, and the anti-damaging layer 44 is located at the notch 13. When the elastic band 4 is being stretched, the side wall of the sleeving through hole 41 contacts and rubs against the pillar 12 beside the notch 13, which is likely to damage the elastic band 4. That is, by configuring the anti-damaging layer 44, the hardness and strength of the elastic band 4 on the side wall of the sleeving through hole 41 can be increased, thereby reducing the friction between the elastic band 4 and the pillar 12 beside the notch 13 when the elastic band 4 is being stretched.

Figure 12:
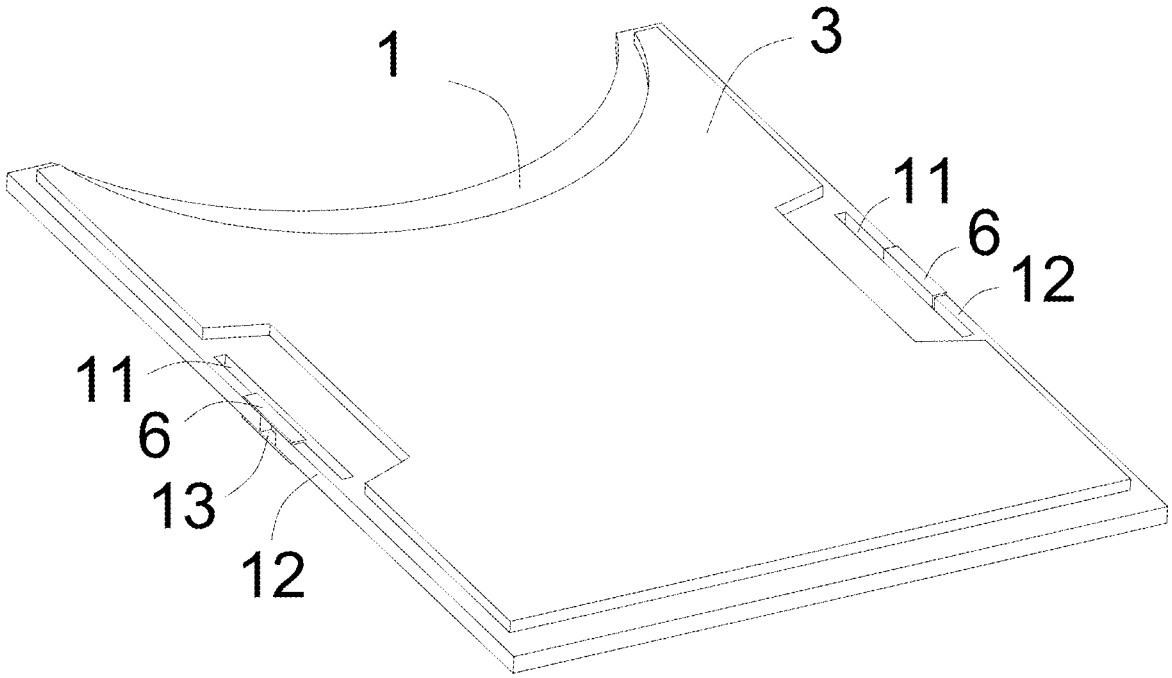
FIG. 12 is a schematic diagram of an assembly of the first clamping plate, a spacer and a decorative cover plate of the present disclosure.

In other embodiments, that is, in embodiments without the anti-damaging layer 44, the wallet 100 further includes a spacer 6. The spacer 6 is configured to prevent the elastic band 4 from being squeezed by the pillar 12 at the notch 13 when the elastic band 4 is being stretched. As shown in FIG. 12, the spacer 6 covers the notch 13 and is located between the elastic band 4 and the pillar 12. In this way, when the elastic band 4 is being stretched, blocked by the spacer 6, the elastic band 4 will not be subjected to squeezing and wearing by the pillar 12 beside the notch 13. This serves to protect the elastic band 4, thereby increasing the service life of the elastic band 4.

Figure 13:
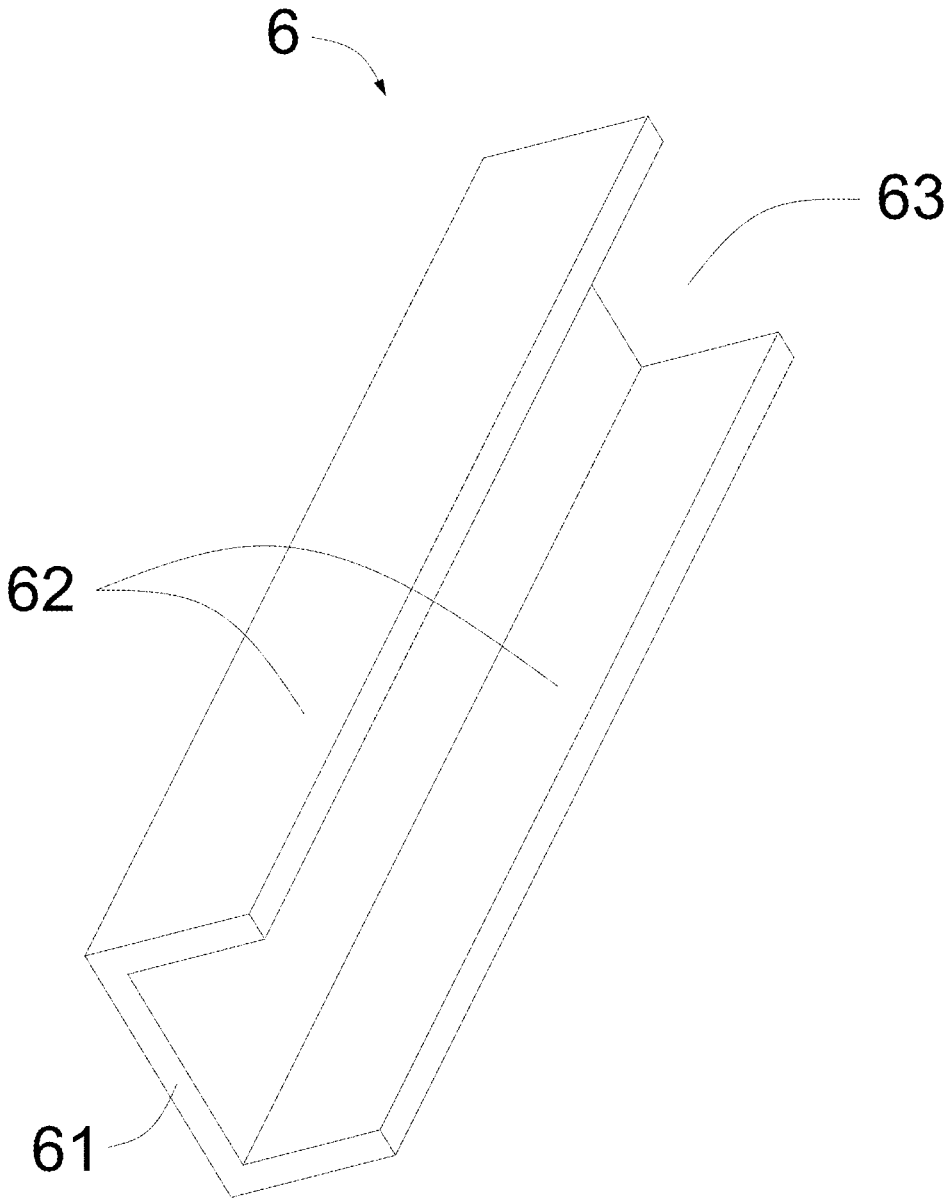
FIG. 13 is a schematic structural diagram of the spacer of the present disclosure.
Figure 14:
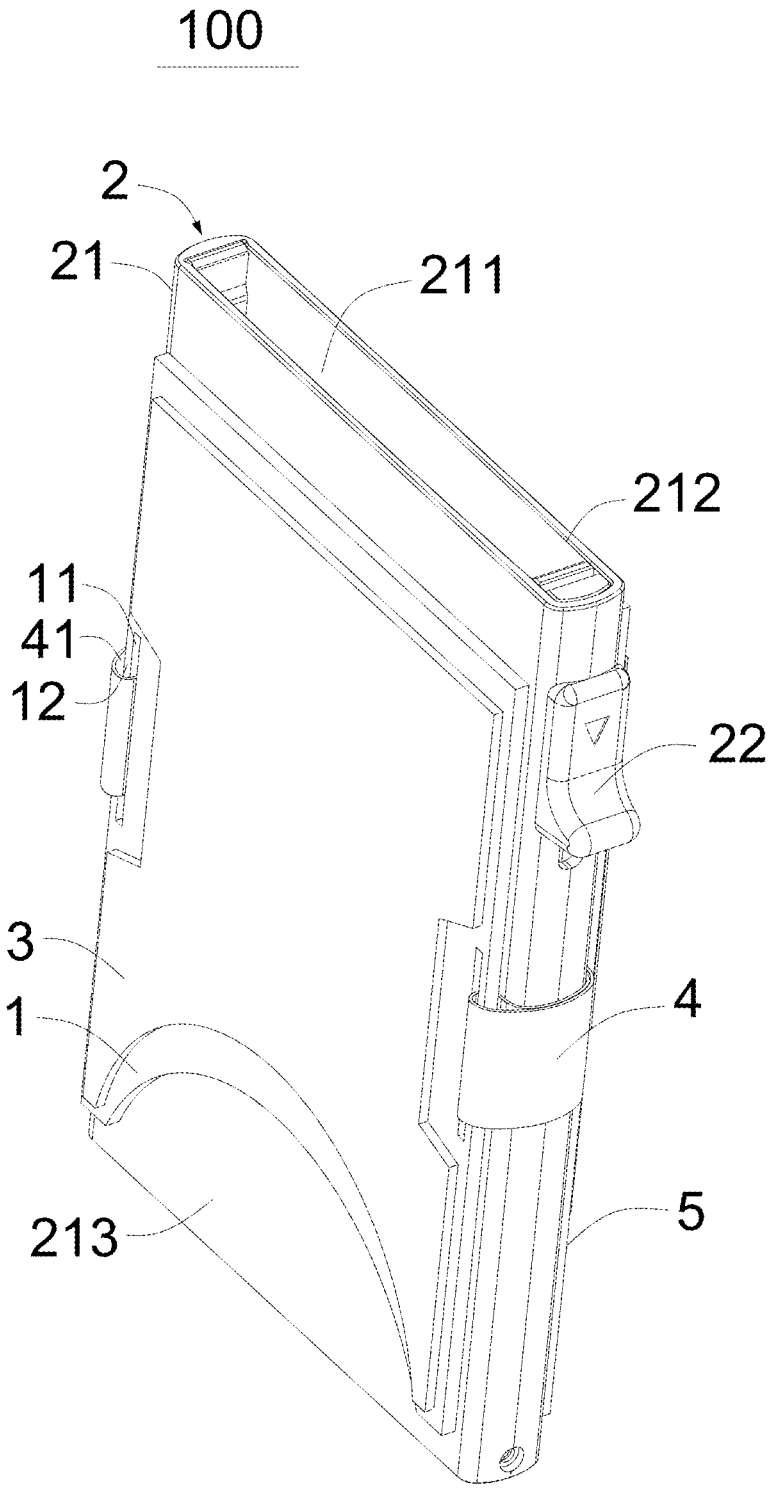
FIG. 14 is a three-dimensional schematic diagram of the second clamping plate in the form of a card box of the present disclosure.
Figure 15:
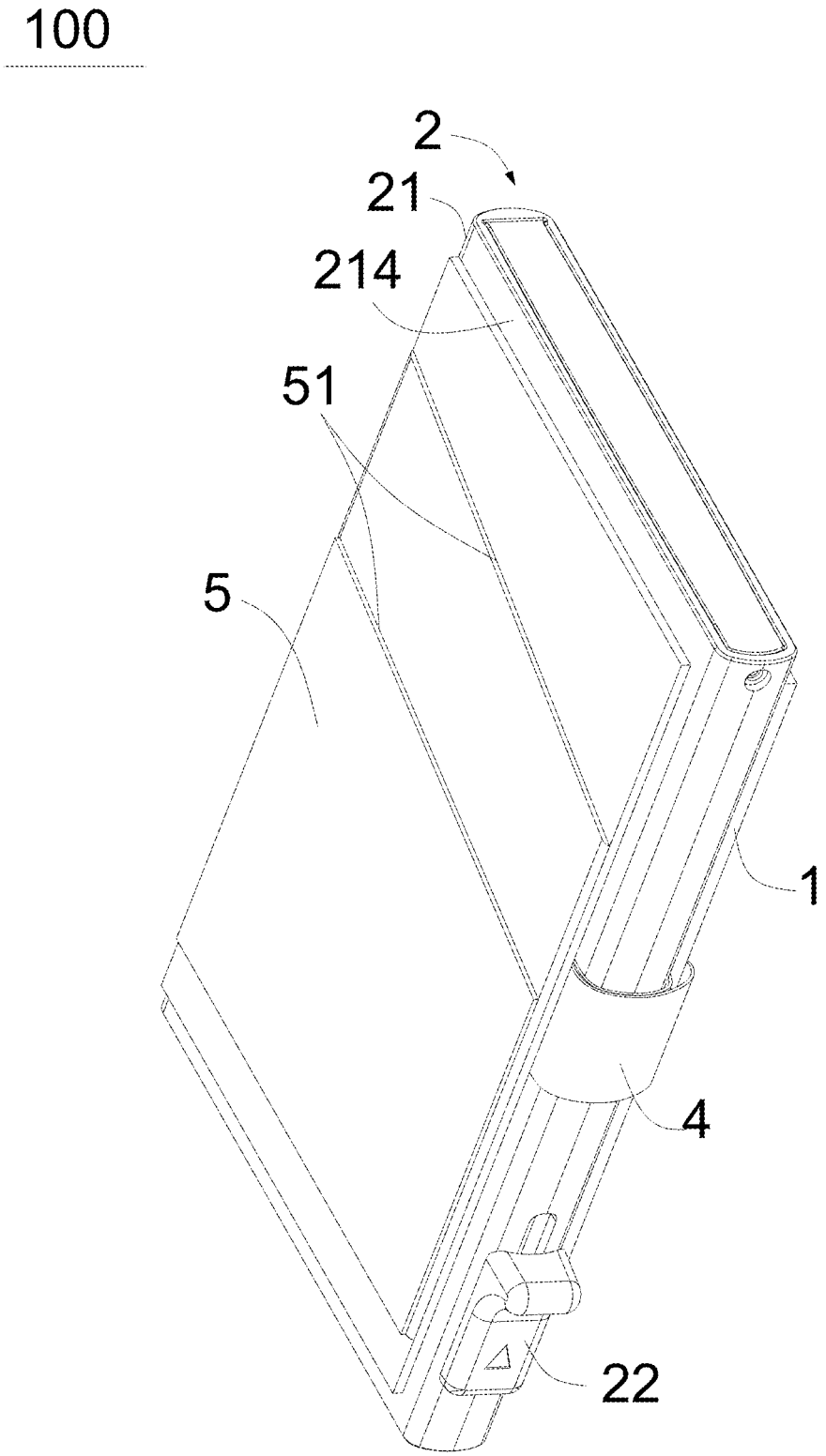
FIG. 15 is a three-dimensional schematic diagram of the second clamping plate in the form of the card box from another view of the present disclosure.
Figure 16:
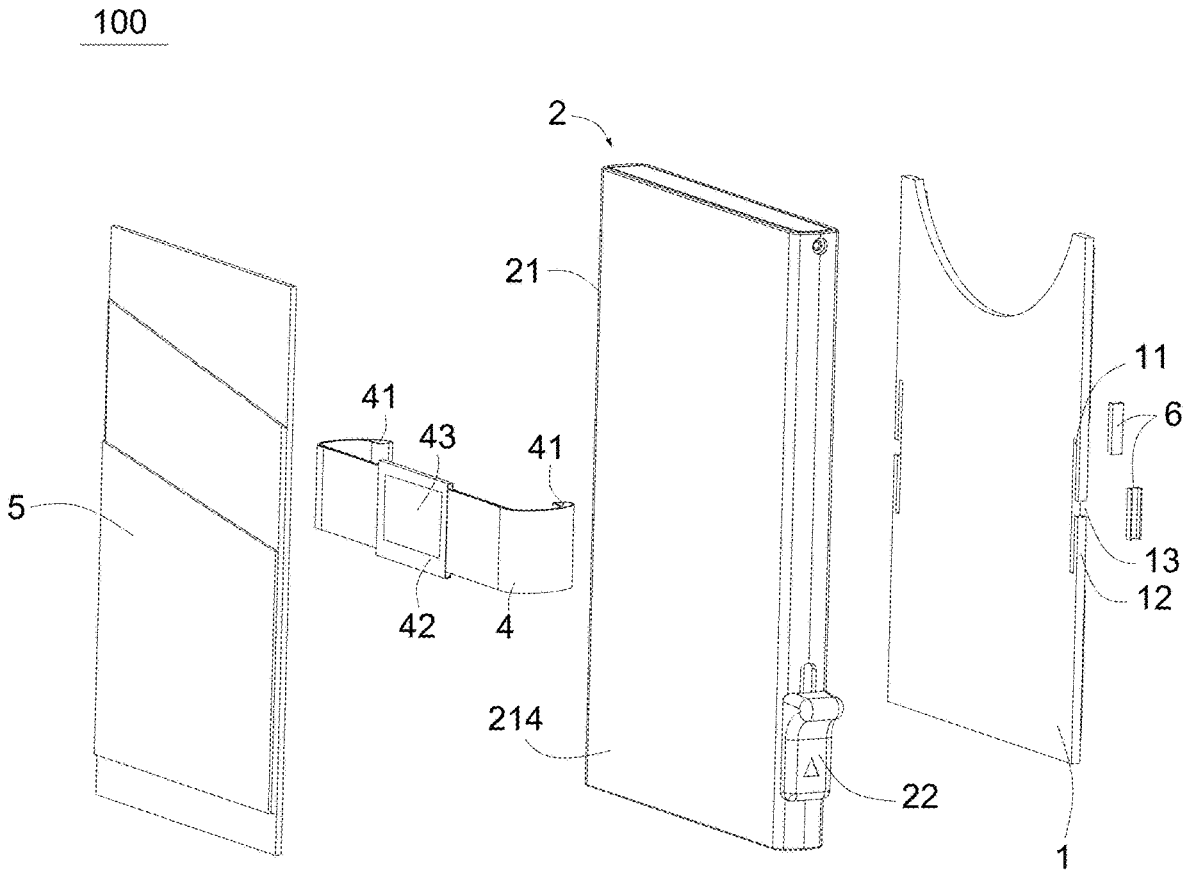
FIG. 16 is an exploded diagram of the second clamping plate in the form of the card box of the present disclosure.
Figure 17:
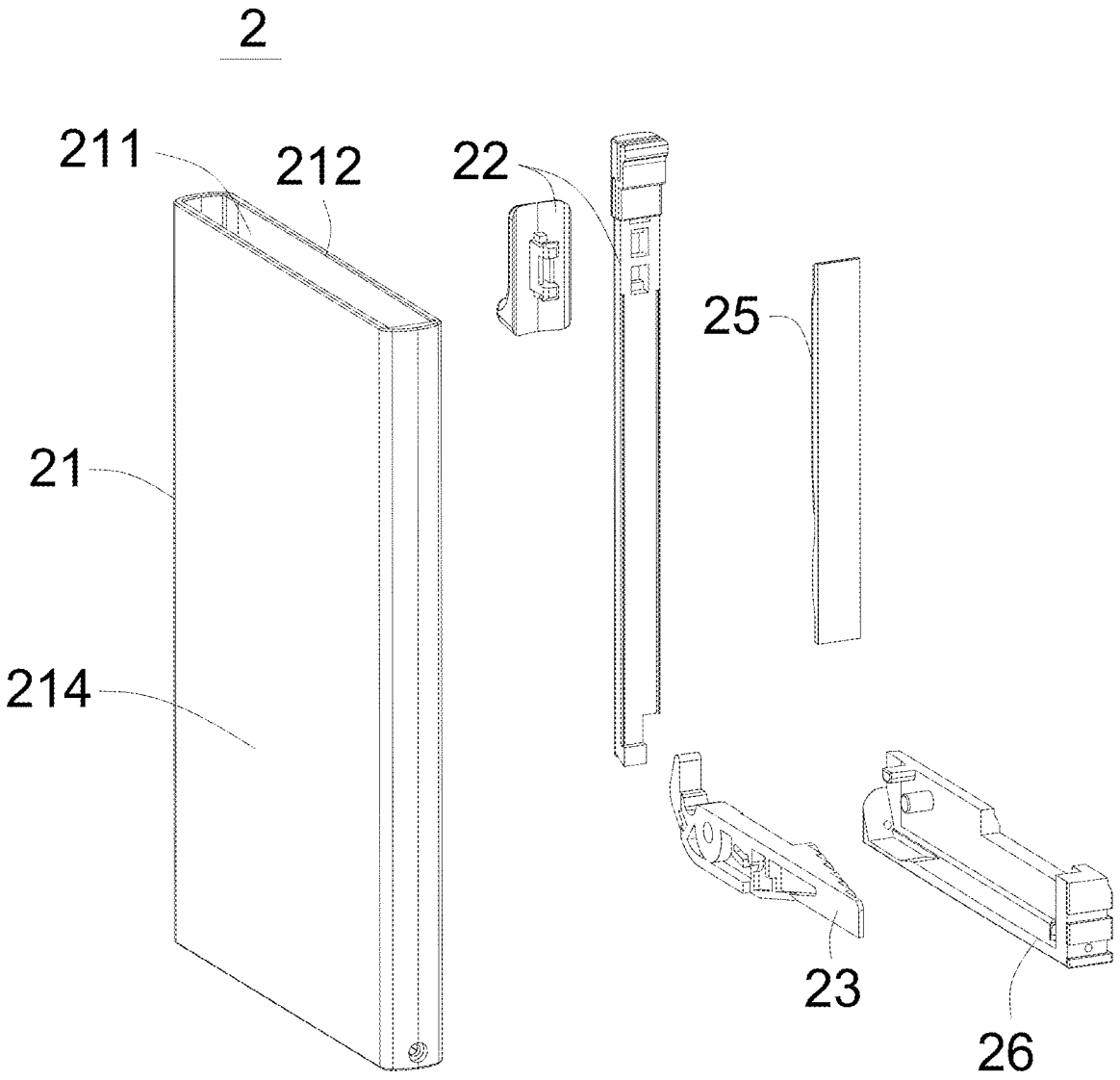
FIG. 17 is an exploded diagram of the card box of the present disclosure.
Figure 18:
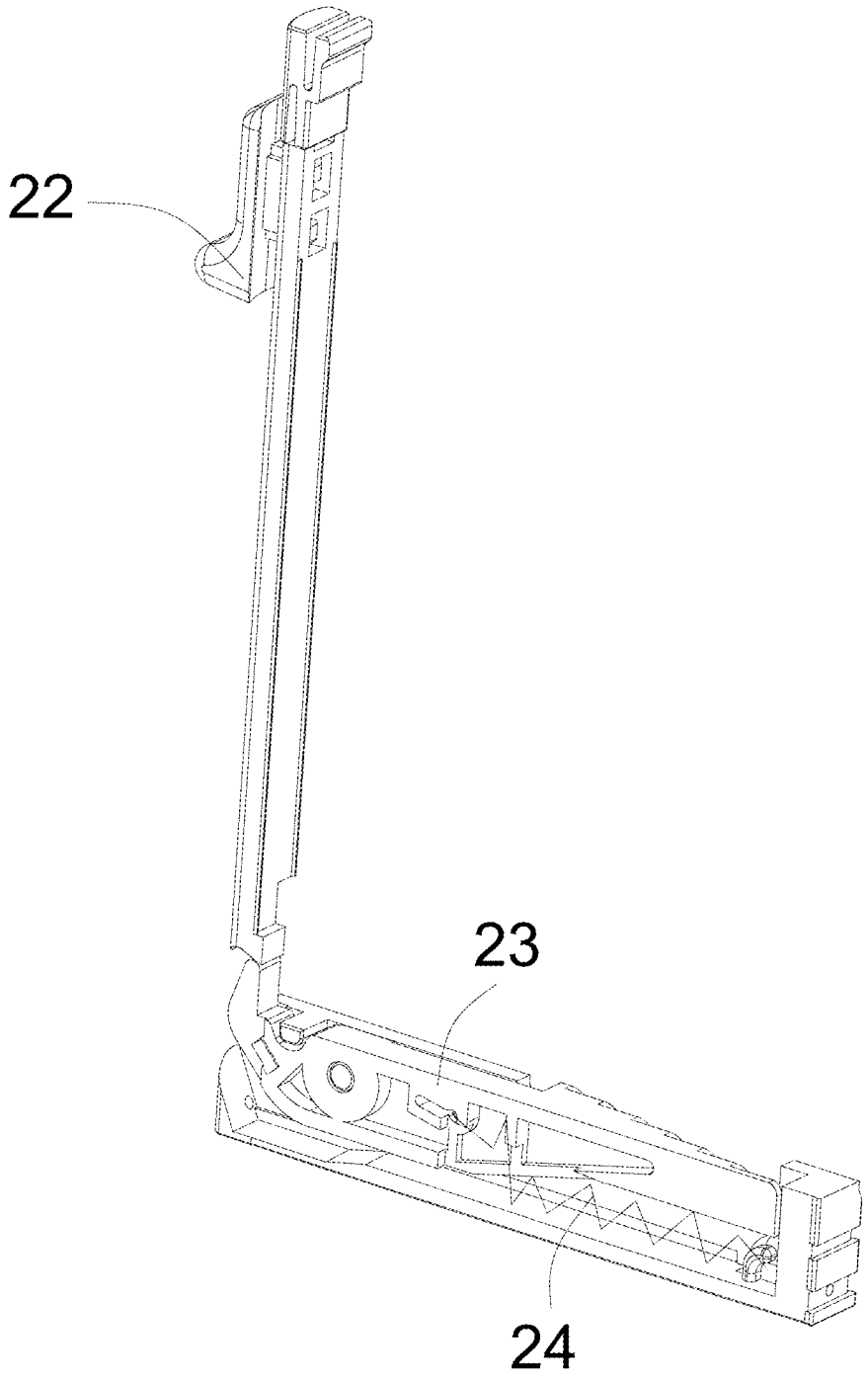
FIG. 18 is a schematic structural diagram of an interior of the card box of the present disclosure.

Specifically, the spacer 6 includes a first baffle plate 61 and second baffle plates 62 extending from both ends of the first baffle plate 61. An embedding groove 63 surrounded by the first baffle plate 61 and the two second baffle plates 62 is formed, as shown in FIG. 13. The notch 13 and at least part of the pillar 12 are placed within the embedding groove 63. This serves to prevent the elastic band 4 from being squeezed and worn by the pillar 12 beside the notch 13.

Certainly, in other embodiments, the spacer 6 can also be in a ring shape, sleeved onto the pillar 12 and covering the notch 13. This can also serve to prevent the elastic band 4 from being squeezed and worn by the pillar 12 beside the notch 13. Moreover, there can also be two spacers 6 respectively arranged on both sides of the pillar 12 and so on. Its function is to prevent the elastic band 4 from being squeezed and worn by the pillar 12 beside the notch 13 when the elastic band 4 is being stretched.

In an embodiment, the spacer 6 is formed by bending a piece of metal sheet. Certainly, the spacer 6 can also be made of plastic sheet, film, resin sheet, lamella and so on.

In an embodiment, an anti-slip rubber pad 46 is arranged on one side of the elastic band 4 adjacent to the outer surface of the second clamping plate 2 for increasing frictional force between the elastic band 4 and the second clamping plate 2.

Figure 7:
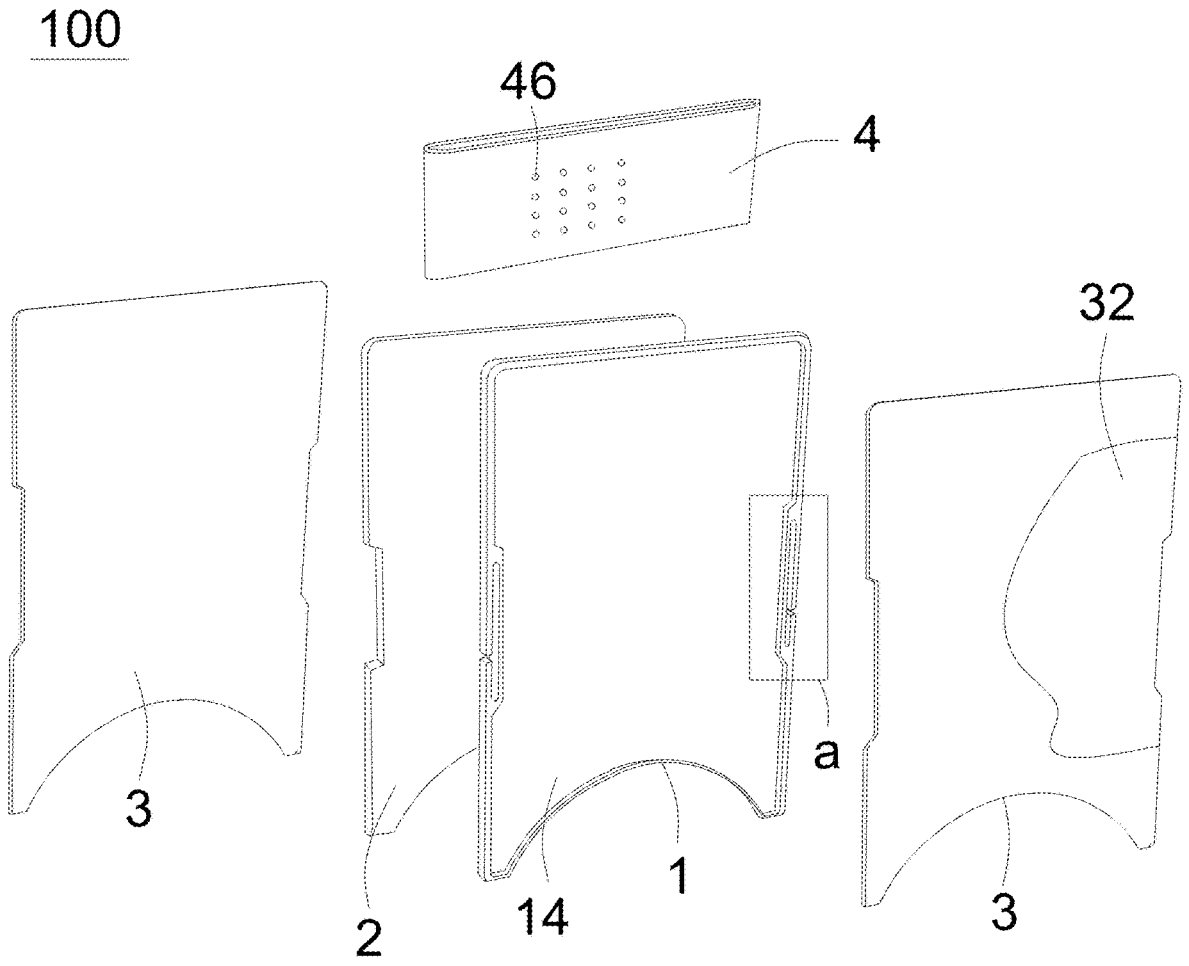
FIG. 7 is an exploded diagram of the vertical-style card holder wallet of the present disclosure.
Figure 8:
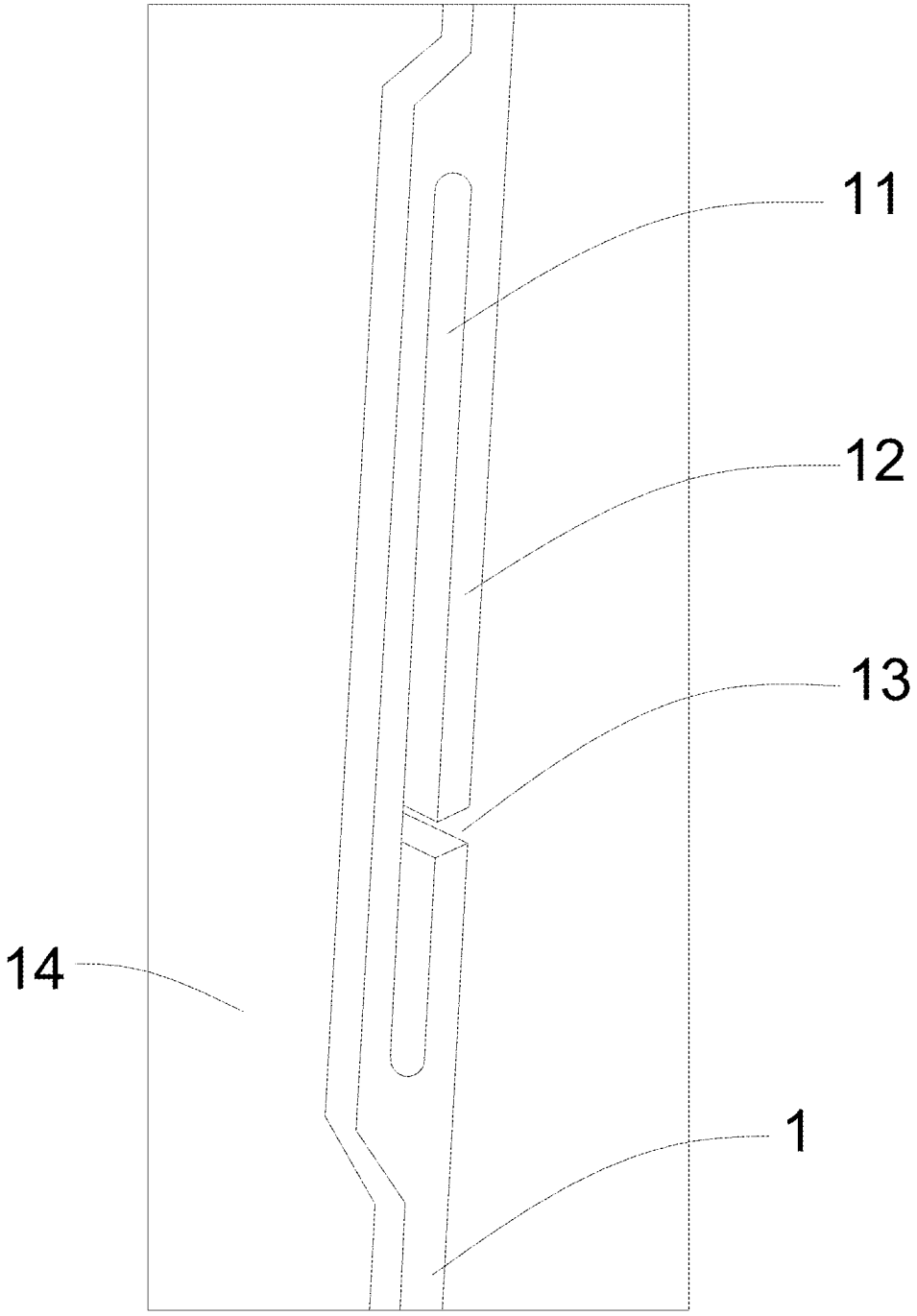
FIG. 8 is an enlarged diagram of an area A in FIG. 7.

As shown in FIG. 7, when the first clamping plate 1 and the second clamping plate 2 move relatively by means of the elastic band 4, this can reduce the movement between the elastic band 4 and the second clamping plate 2 and prevent the second clamping plate 2 from detaching from the elastic band 4. Thus, the structural stability of the card holder wallet 100 in this embodiment can be improved.

Figure 10:
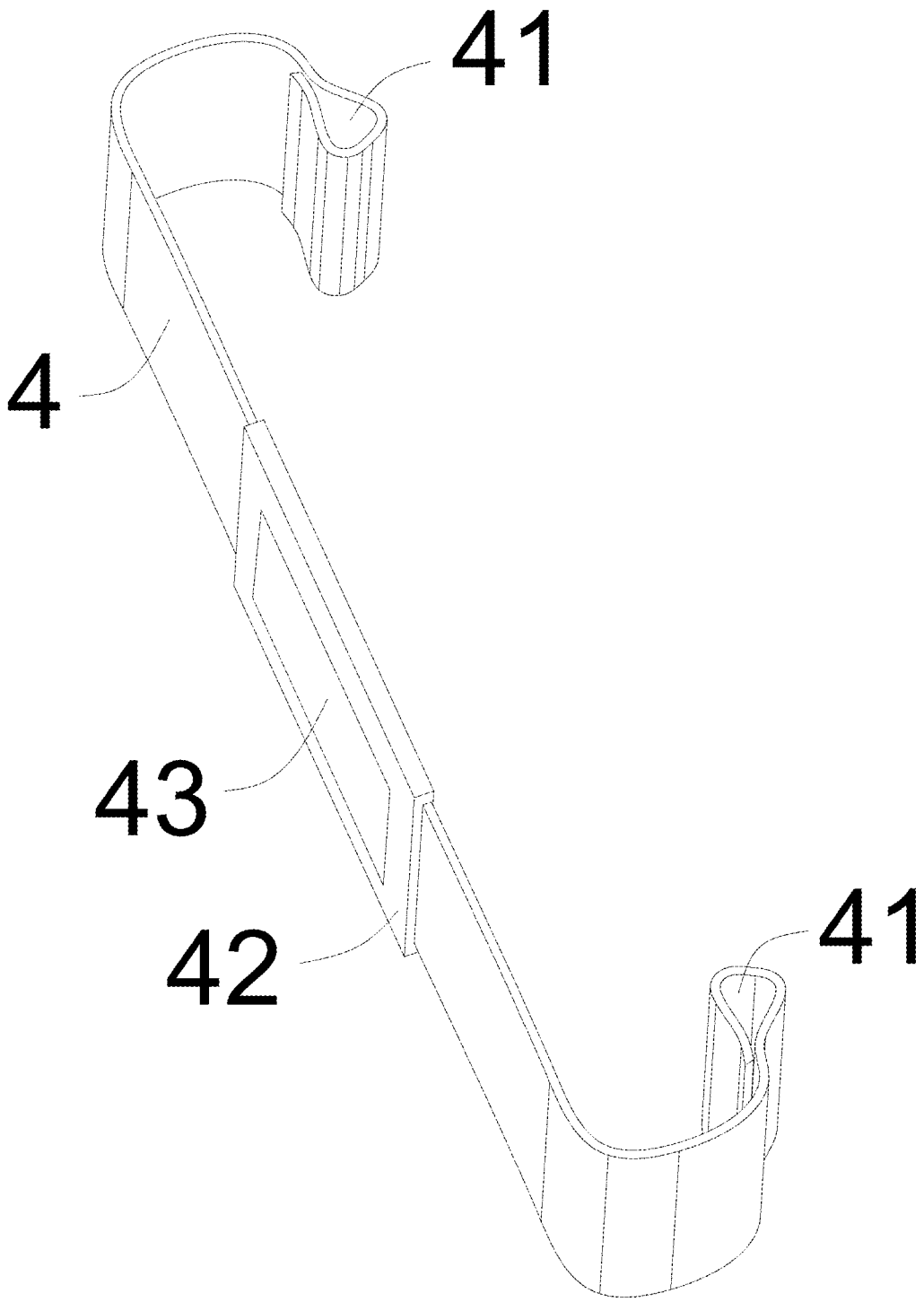
FIG. 10 is a schematic diagram of the elastic band of another embodiment of the present disclosure.

In the above embodiment, the number of the elastic bands 4 is one, and both ends of the elastic band are folded back and forth and then sewn to form the sleeving through holes 41. As shown in FIG. 10, that is, the number of layers of the elastic band 4 that bypasses the second clamping plate 2 away from the first clamping plate 1 and the back surface 214 is one.

Figure 9:
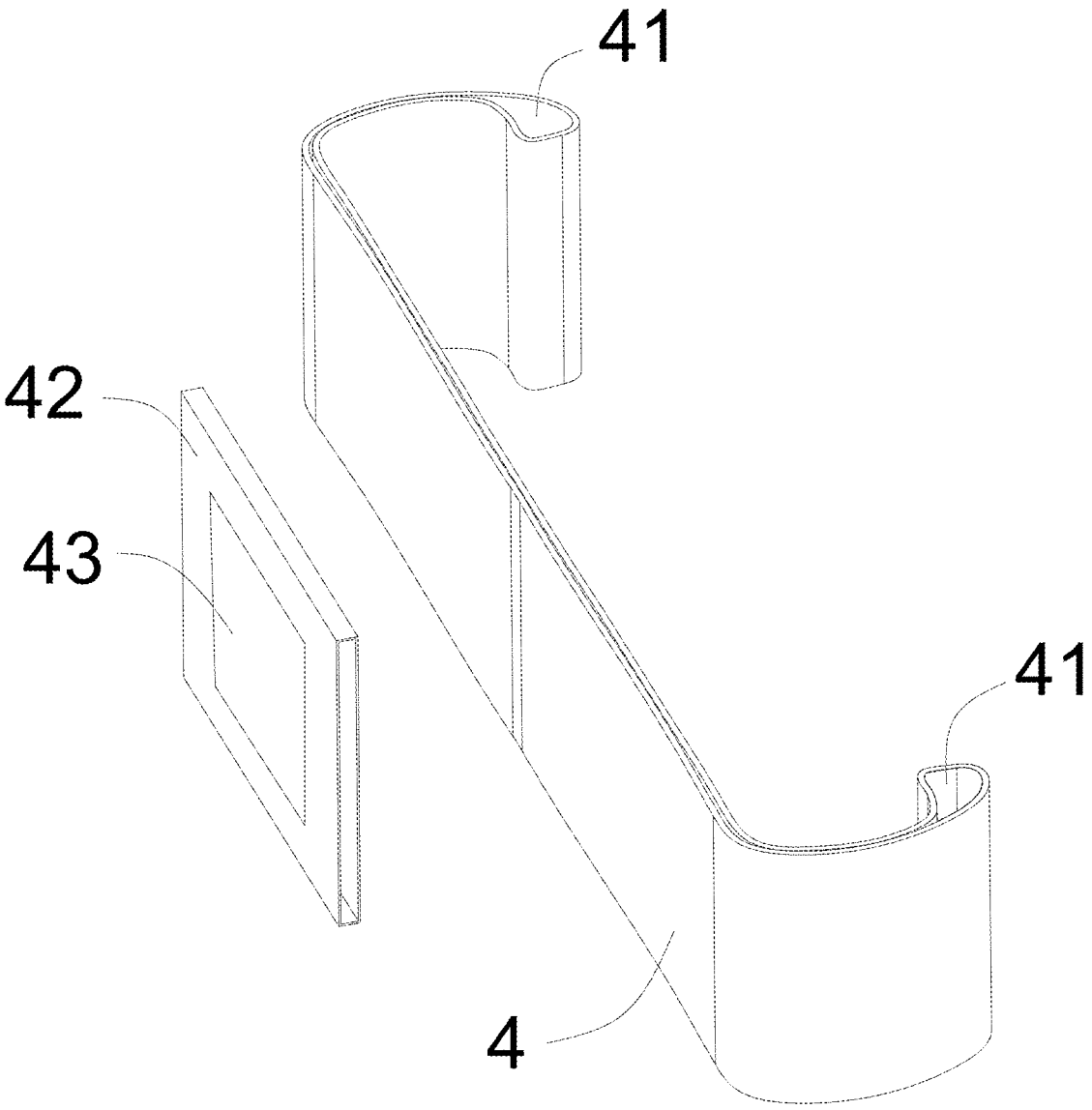
FIG. 9 is an exploded view of an annular elastic band and a shielding member of the present disclosure.

In another embodiment, the elastic band 4 is in a ring shape, the sleeving through holes 41 located at both ends of the elastic band 4 are connected to each other, and the number of layers of the elastic band 4 on the outer surface of the second clamping plate 2 is two, arranged in an overlapping manner, as shown in FIG. 9. The structure of the elastic band 4 is simple. It only requires connecting the two ends of a single elastic band 4 to form a ring shape, thus forming the elastic band 4 into a ring. In this way, when the two ends of the elastic band 4 are sleeved onto the pillars 12 on both sides of the first clamping plate 1, the number of layers of the elastic band 4 that bypasses the outer surface of the second clamping plate 2 is two. This effectively increases the clamping force between the first clamping plate 1 and the second clamping plate 2, and can effectively increase the number of times the elastic band 4 is stretched, thus effectively increasing the service life of the elastic band 4.

In this embodiment, a shielding member 42 is arranged around the joint of the two ends of the elastic band 4. This can cover the seam of the elastic band 4, as shown in FIG. 9. Moreover, with the shielding member 42, it is convenient to configure a logo 43, improving the aesthetics of the card holder wallet 100 in this embodiment. Specifically, the shielding member 42 can be made of film, leather and so on, and can be fixed by means of pasting and/or sewing. Additionally, the shielding member 42 makes it convenient for users to clip banknotes or the card 10 between the elastic band 4 and the second clamping plate 2, facilitating users' use.

Certainly, in other embodiments, the ring-shaped elastic band 4 can also be formed by connecting the head and tail of a plurality of elastic bands 4 and so on.

In an embodiment, a decorative cover plate is arranged on the outer surface of the first clamping plate 1 and/or the outer surface of the second clamping plate 2. Specifically, the decorative cover plate 3 on the second clamping plate 2 is located between the second clamping plate 2 and the elastic band 4. The decorative cover plate 3 on the first clamping plate 1 is arranged to avoid the pillar 12. In this way, when users replace the elastic band 4, they do not need to detach the decorative cover plate 3. Instead, they can directly take out the two ends of the elastic band 4 from the notch 13, which facilitates the replacement of the elastic band 4 by users.

In an embodiment, to improve the structural compactness of the card holder wallet 100 in this embodiment, an embedded groove 14 is formed on the outer surface of the first clamping plate 1 and/or the second clamping plate 2, and at least part of the decorative cover plate 3 is placed in the embedded groove 14.

In an embodiment, the decorative cover plate 3 is formed by splicing at least two different materials to enhance the aesthetics of the decorative cover plate 3.

In an embodiment, the decorative cover plate 3 is formed by injection molding after putting a hard plate 32 into a mold and adding a molten material, thereby achieving the formation of the decorative cover plate 3 by splicing at least two different materials.

In an embodiment, the hard plate 32 can be one or more of wood blocks, stones, metal blocks, carbon fiber blocks, plastics and resins, and the molten material can be one or more of plastics, resins and metals.

Certainly, in other embodiments, the decorative cover plate 3 can also be made of one material, such as metal, wood, stone, carbon fiber, plastic, leather and so on.

In an embodiment, the second clamping plate 2 is in a plate shape.

In an embodiment, the second clamping plate 2 is a card box. The card box includes a shell 21, a card pushing member 23, a reset member 24 and a driving member 22 for users to operate. An accommodating groove 211 with one side being an opening 212 is arranged inside the shell 21, and the accommodating groove 211 is configured to store cards. The card pushing member 23 and the reset member 24 are placed inside the accommodating groove 211, and the card pushing member 23 is rotatably arranged inside the shell 21. One end of the reset member 24 is fixed on the shell 21, and the other end of the reset member 24 is fixed on the card pushing member 23. The driving member 22 is movably arranged on the shell 21 and is connected to the card pushing member 23. When the driving member 22 is operated, the card pushing member 23 rotates to push a card out of the accommodating groove 211, and after the card pushing member 23 is rotated, the reset member 24 generates a reset acting force to drive the card pushing member 23 to return to its initial position. The shell 21 includes a back surface 214 and a front surface 213 opposite to the back surface 214, and the front surface 213 is opposite to the first clamping plate 1, and the elastic band 4 bypasses from the back surface 214. The second clamping plate 2 serves as a card box, which can effectively increase the number of the card 10 that can be stored.

In an embodiment, the card box is provided with an anti-slip layer 25 on at least one side wall of the accommodating groove 211. When the cards 10 are stored in the accommodating groove 211, this can prevent the cards 10 from detaching from the accommodating groove 211 through the opening 212 without external force.

In an embodiment, a support 26 is arranged inside the card box. The card pushing member 23 is rotatably arranged on the support 26. The reset member 24 is a tension spring. The two ends of the tension spring are respectively fixed to the support 26 and the card pushing member 23. That is, when the driving member 22 slides downward to push one end of the card pushing member 23 to move downward, the card pushing member 23 rotates, causing the other end of the card pushing member 23 to move upward, thereby pushing out the card 10.

In an embodiment, the back surface 214 is provided with a card sleeve 5, at least one of the card sleeves is provided with a card slot 51 for inserting the cards 10. By using the card sleeve 5, items such as cards 10, banknotes, airtag and keys can be stored, which improves the practicality of the card holder wallet 100. This makes it convenient for users to swipe cards and take out the banknotes they need. At least part of the opening 212 of the card groove 51 is located inside the periphery of the card sleeve 5, thereby facilitating the placement and retrieval of cards 10 or banknotes. Specifically, the card sleeve 5 can be fixed to the back surface 214 by glue or double faced adhesive tape, and the card sleeve 5 is located between the elastic band 4 and the back surface 214, or the elastic band 4 is located between the card sleeve 5 and the back surface 214. The number of the card slot 51 can be one or more.

In other embodiments, the pillar 12 may not be integrally formed with the first clamping plate 1. That is, the pillar 12 can be fixed to the first clamping plate 1 by means of assembly, but there is still an avoidance hole 11 formed between the pillar 12 and the first clamping plate 1 for avoiding the elastic band 4. Specifically, the pillar 12 can be fixed to the first clamping plate 1 by means of screws or gluing. Alternatively, the first clamping plate 1 has insertion openings at both ends of the avoidance hole 11. The pillar 12 is elastic or telescopic, and both ends of the pillar 12 are respectively placed in the insertion openings. This can also achieve the fixation of the pillar 12 to the first clamping plate 1. Here, the way of fixing the pillar 12 to the first clamping plate 1 is not limited.

It should be noted that all directional indications (such as up, down, left, right, front, back . . . ) in the embodiments of the present invention are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present invention are only used for descriptive purposes, and cannot be understood as indicating or implying its relative importance or implicitly indicating the number of technical features indicated. Therefore, features defined by "first" and "second" can explicitly instruct or impliedly include at least one feature. In addition, "and/or" in the entire text includes three solutions. A and/or B is taken as an example, including technical solution A, technical solution B, and technical solutions that both A and B satisfy. In addition, the technical solutions between the various embodiments can be combined with each other, but it needs be based on what can be achieved by those of ordinary skill in the art. When the combination of the technical solutions is contradictory or cannot be achieved, it should be considered that such a combination of the technical solutions does not exist, and is not within the scope of protection claimed by the present invention.

The above descriptions are only preferred embodiments of the present invention, and are not intended to limit the patent scope of the present invention. Any equivalent structural transformation made by using the content of the specification and the drawings of the present invention under the invention idea of the present invention, directly or indirectly applied to other related technical fields, shall all be included in the scope of patent protection of the present invention.

What is claimed is:

1. A card holder wallet comprising, a first clamping plate, a second clamping plate and an elastic band, wherein two pillars are arranged at intervals on an outer side of the first clamping plate, a sleeving through hole is formed at each of two ends of the elastic band, and the sleeving through hole extends along a width direction of the elastic band;

both ends of the elastic band are sleeved on the two pillars respectively, and the two pillars are respectively positioned in the sleeving through holes at the two ends of the elastic band; the elastic band is looped around the second clamping plate away from an outer surface of the first clamping plate, the first clamping plate is located away from an outer surface of the second clamping plate, and there is no elastic band on the outer surface of the first clamping plate between the two pillars.

2. The card holder wallet according to claim 1, wherein the first clamping plate is provided with an avoidance hole adjacent to each of two sides of the first clamping plate, the pillar is formed by a side wall of the first clamping plate and an inner side wall of the avoidance hole being spaced apart, and the pillar is provided with a notch for sleeving the elastic band onto the pillar.

3. The card holder wallet according to claim 2, wherein the notch is not located at an end position of the pillar.

4. The card holder wallet according to claim 3, wherein the elastic band is provided with an anti-damaging layer for increasing strength on an inner side wall corresponding to the sleeving through hole, a material of the anti-damaging layer is a glue or a resin layer, and the anti-damaging layer is located at the notch.

5. The card holder wallet according to claim 3, wherein the card holder wallet further comprises a spacer configured to prevent the elastic band from being squeezed with the pillar at the notch when being stretched, the spacer covers the notch, and the spacer is located between the elastic band and the pillar.

6. The card holder wallet according to claim 5, wherein the spacer comprises a first baffle plate and second baffle plates extending from both ends of the first baffle plate, an embedding groove surrounded by the first baffle plate and the two second baffle plates is formed, and the notch and at least part of the pillar are placed within the embedding groove.

7. The card holder wallet according to claim 6, wherein the spacer is formed by bending a piece of metal sheet.

8. The card holder wallet according to claim 3, wherein a width of the notch matches substantially a thickness of the elastic band.

9. The card holder wallet according to claim 3, wherein the width of the notch is greater than the thickness of the elastic band by 0 mm to 5 mm.

10. The card holder wallet according to claim 2, wherein the notch is located at a middle of the pillar or adjacent to the middle of the pillar.

11. The card holder wallet according to claim 1, wherein the number of the elastic bands is one, and both ends of the elastic band are folded back and forth and then sewn to form the sleeving through holes.

12. The card holder wallet according to claim 1, wherein the elastic band is in a ring shape, the sleeving through holes located at both ends of the elastic band are connected to each other, and the number of layers of the elastic band on the outer surface of the second clamping plate is two, arranged in an overlapping manner.

13. The card holder wallet according to claim 12, wherein the number of the elastic bands is one, and two ends of the elastic band are connected to form a ring shape; a shielding member is arranged around a joint of the two ends of the elastic band, and the shielding member is provided with a logo.

14. The card holder wallet according to claim 1, wherein an anti-slip rubber pad is arranged on one side of the elastic band adjacent to the outer surface of the second clamping plate for increasing a frictional force between the elastic band and the second clamping plate.

15. The card holder wallet according to claim 1, wherein a decorative cover plate is arranged on the outer surface of the first clamping plate and/or the outer surface of the second clamping plate.

16. The card holder wallet according to claim 15, wherein the decorative cover plate is formed by splicing at least two different materials.

17. The card holder wallet according to claim 16, wherein the decorative cover plate is formed by injection molding after putting a hard plate into a mold and adding a molten material.

18. The card holder wallet according to claim 17, wherein the hard plate is one or more of wood blocks, stones, metal blocks, carbon fiber blocks, plastics and resins, and the molten material is one or more of plastics, resins and metals.

19. The card holder wallet according to claim 1, wherein the second clamping plate is a card box, the card box comprises a shell, a card pushing member, a reset member and a driving member for users to operate, an accommodating groove with one side being an opening is arranged inside the shell, the accommodating groove is configured to store cards, the card pushing member and the reset member are placed inside the accommodating groove, the card pushing member is rotatably arranged inside the shell, one end of the reset member is fixed on the shell, the other end of the reset member is fixed on the card pushing member, and the driving member is movably arranged on the shell and is connected to the card pushing member;

when the driving member is operated, the card pushing member rotates to push a card out of the accommodating groove, and after the card pushing member is rotated, the reset member generates a reset acting force to drive the card pushing member to return to its initial position;

the shell comprises a back surface and a front surface opposite to the back surface, the front surface is opposite to the first clamping plate, and the elastic band bypasses from the back surface.

20. The card holder wallet according to claim 19, wherein the back surface is provided with a card sleeve, at least one of the card sleeves is provided with a card slot for inserting the card, and at least part of the opening of the card slot is located inside a periphery of the card sleeve.

* * * * *